US007073276B2

(12) United States Patent
Swigart

(10) Patent No.: US 7,073,276 B2
(45) Date of Patent: Jul. 11, 2006

(54) FOOTWEAR SOLE COMPONENT WITH A SINGLE SEALED CHAMBER

(75) Inventor: John F. Swigart, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 10/845,302

(22) Filed: May 14, 2004

(65) Prior Publication Data

US 2004/0216330 A1 Nov. 4, 2004

Related U.S. Application Data

(62) Division of application No. 10/143,745, filed on May 9, 2002, now Pat. No. 6,796,056.

(51) Int. Cl.
*A43B 13/20* (2006.01)
*A43B 21/28* (2006.01)
*A43B 21/32* (2006.01)

(52) U.S. Cl. ..... 36/29; 36/35 B; 36/37

(58) Field of Classification Search ..... 36/28, 36/29, 35 B, 37, 71, 35 R, 141, 91, 192
See application file for complete search history.

(56) References Cited

U.S. PATENT DOCUMENTS

| | | | |
|---|---|---|---|
| 1,193,608 | A | 8/1916 | Poulson |
| 1,240,153 | A | 9/1917 | Olsen |
| 2,086,389 | A | 7/1937 | Pearson |
| 2,365,807 | A | 12/1944 | Dialynas |
| 2,488,382 | A | 11/1949 | Davis |
| 2,605,560 | A | 8/1952 | Gouabault |
| 2,762,134 | A | 9/1956 | Town |
| 3,469,576 | A | 9/1969 | Smith et al. |
| 3,724,106 | A | 4/1973 | Magidson |
| 4,017,931 | A | 4/1977 | Golden |
| 4,115,934 | A | 9/1978 | Hall |
| 4,297,797 | A | 11/1981 | Meyers |
| 4,358,902 | A | 11/1982 | Cole et al. |
| 4,370,754 | A | 2/1983 | Donzis |
| 4,431,003 | A | 2/1984 | Sztancsik |
| 4,441,211 | A | 4/1984 | Donzis |
| 4,445,283 | A | 5/1984 | Meyers |
| 4,446,634 | A | 5/1984 | Johnson et al. |
| 4,453,271 | A | 6/1984 | Donzis |
| 4,486,901 | A | 12/1984 | Donzis |
| 4,494,321 | A | 1/1985 | Lawlor |

(Continued)

FOREIGN PATENT DOCUMENTS

| | | |
|---|---|---|
| CN | 54221 | 6/1978 |

(Continued)

OTHER PUBLICATIONS

Internet Advertisement "Deer Stags, The S.U.P.R.O Sock" Printed Apr. 12, 2000.

(Continued)

*Primary Examiner*—Anthony Stashick
(74) *Attorney, Agent, or Firm*—Banner & Witcoff, Ltd.

(57) ABSTRACT

A sole component for footwear combining the desirable response characteristics of a fluid filled chamber and an elastomeric material. The chamber can be formed as a single bladder chamber in contact with an elastomeric midsole, or a single chamber formed by a sealing a void in elastomeric material. The interface between the chamber and elastomeric material is sloped and gradual so that the shape of the chamber and its placement in a midsole determine the combination of response characteristics in the sole component. The chamber has a relatively simple shape with one axis of symmetry with a rounded portion and a narrow portion.

26 Claims, 8 Drawing Sheets

U.S. PATENT DOCUMENTS

| | | | | |
|---|---|---|---|---|
| 4,513,449 | A | 4/1985 | Donzis | |
| 4,535,553 | A | 8/1985 | Derderian et al. | |
| 4,577,417 | A * | 3/1986 | Cole | 36/29 |
| 4,670,995 | A | 6/1987 | Huang | |
| 4,779,359 | A | 10/1988 | Famolare, Jr. | |
| 4,803,029 | A | 2/1989 | Iversen et al. | |
| 4,874,640 | A | 10/1989 | Donzis | |
| 4,906,502 | A | 3/1990 | Rudy | |
| 4,936,029 | A | 6/1990 | Rudy | |
| 4,999,931 | A * | 3/1991 | Vermeulen | 36/29 |
| 5,042,176 | A | 8/1991 | Rudy | |
| 5,083,361 | A | 1/1992 | Rudy | |
| D328,159 | S | 7/1992 | Donzis | |
| 5,179,792 | A | 1/1993 | Brantingham | |
| 5,199,191 | A | 4/1993 | Moumdjian | |
| 5,224,277 | A | 7/1993 | Sang Do | |
| 5,224,278 | A | 7/1993 | Jeon | |
| 5,235,715 | A | 8/1993 | Donzis | |
| 5,245,766 | A | 9/1993 | Warren | |
| 5,253,435 | A | 10/1993 | Auger et al. | |
| 5,353,459 | A | 10/1994 | Potter et al. | |
| 5,353,523 | A | 10/1994 | Kilgore et al. | |
| 5,406,719 | A | 4/1995 | Potter | |
| 5,543,194 | A | 8/1996 | Rudy | |
| 5,595,004 | A | 1/1997 | Lyden et al. | |
| 5,625,964 | A | 5/1997 | Lyden et al. | |
| 5,638,612 | A | 6/1997 | Donzis | |
| 5,653,046 | A | 8/1997 | Lawlor | |
| 5,685,090 | A | 11/1997 | Tawney et al. | |
| 5,701,687 | A | 12/1997 | Schmidt et al. | |
| 5,704,137 | A | 1/1998 | Dean et al. | |
| 5,706,589 | A | 1/1998 | Marc | |
| 5,713,141 | A | 2/1998 | Mitchell et al. | |
| 5,741,568 | A | 4/1998 | Rudy | |
| 5,771,606 | A | 6/1998 | Litchfield et al. | |
| 5,794,275 | A | 8/1998 | Donzis | |
| 5,813,142 | A | 9/1998 | Demon | |
| 5,881,395 | A | 3/1999 | Donzis | |
| 5,894,683 | A | 4/1999 | Lin | |
| 5,894,687 | A * | 4/1999 | Lin | 36/141 |
| 5,902,660 | A | 5/1999 | Huang | |
| 5,952,065 | A | 9/1999 | Mitchell et al. | |
| 5,956,869 | A * | 9/1999 | Kim | 36/29 |
| 5,979,078 | A * | 11/1999 | McLaughlin | 36/29 |
| 5,987,780 | A | 11/1999 | Lyden et al. | |
| 6,009,637 | A | 1/2000 | Pavone | |
| 6,013,340 | A | 1/2000 | Bonk et al. | |
| 6,055,746 | A | 5/2000 | Lyden et al. | |
| 6,119,371 | A | 9/2000 | Goodwin et al. | |
| 6,127,010 | A | 10/2000 | Rudy | |
| 6,128,837 | A | 10/2000 | Huang | |
| 6,175,967 | B1 | 1/2001 | Donzis | |
| 6,176,025 | B1 | 1/2001 | Patterson et al. | |
| 6,266,897 | B1 | 7/2001 | Seydel et al. | |
| RE37,705 | E | 5/2002 | Donzis | |
| 6,425,195 | B1 | 7/2002 | Donzis | |
| 6,505,420 | B1 * | 1/2003 | Litchfield et al. | 36/29 |
| 6,510,624 | B1 * | 1/2003 | Lakic | 36/29 |

FOREIGN PATENT DOCUMENTS

| | | | |
|---|---|---|---|
| DE | 352216 | | 4/1922 |
| EP | 301331 | A2 * | 2/1989 |
| EP | 0768047 | A2 * | 4/1997 |
| EP | 0 780 064 | A2 | 6/1997 |
| FR | 1406610 | | 11/1965 |
| FR | 2407008 | | 5/1979 |
| GB | 14955 | | 6/1894 |
| GB | 2050145 | | 1/1981 |
| WO | WO91/11931 | | 8/1991 |
| WO | WO92/08384 | | 5/1992 |
| WO | WO 93/12685 | | 7/1993 |
| WO | WO 93/12685 | A1 * | 7/1993 |
| WO | WO95/20332 | | 8/1995 |
| WO | WO 97/03582 | | 2/1997 |
| WO | WO98/09546 | | 3/1998 |
| WO | WO 01/19211 | | 3/2001 |

OTHER PUBLICATIONS

Internet Advertisement "Bend me, flex me . . . better yet . . . Try Me On!" Printed Apr. 12, 2000.

Photograph "S.U.P.R.O. Sock " (square); Manufactured at least one year prior to the filing date of the application.

Picture "S.U.P.R.O. Sock" (rounded-square); Manufactured at least one year prior to the filing date of the application.

Photograph "S 93' M's Health Walker Plus"—NIKE Bladder, Manufactured 1993.

Photograph "S 94' Air Unlimited Bball"—NIKE Bladder, Manufactured 1994.

Photograph "S 95 Air Go LWP Bball"—NIKE Bladder, Manufactured 1995.

Photograph "S 93 W's Health Walker Plus"—NIKE Bladder, Manufactured 1993.

Article "Merrell Hiking Boots"—Published in either 1992 or 1993.

* cited by examiner $P_2 > P_1 > P_0$
$T_2 > T_1 > T_0$ $P_3 > P_2 > P_1 > P_0$
$T_3 > T_2 > T_1 > T_0$

FOOTWEAR SOLE COMPONENT WITH A SINGLE SEALED CHAMBER

CROSS-REFERENCE TO RELATED APPLICATION

This U.S. patent application is a divisional application of and claims priority to U.S. patent application Ser. No. 10/143,745, which was filed in the U.S. Patent and Trademark Office on May 9, 2002 and entiled Footwear Sole Component With A Single Sealed Chamber now U.S. Pat. No. 6,796,056, such prior U.S. patent application being entirely incorporated herein by reference.

BACKGROUND OF THE INVENTION

1. Field of the Invention

The present invention relates to an improved cushioning system for athletic footwear which provides a large deflection for cushioning the initial impact of footstrike, a controlled stiffness response, a smooth transition to bottom-out and stability, and more specifically to a system which allows for customization of these response characteristics by adjustment of the orientation of a single bladder in a resilient foam material.

2. Description of Related Art

Basketball, tennis, running, and aerobics are but a few of the many popular athletic activities which produce a substantial impact on the foot when the foot strikes the ground. To cushion the strike force on the foot, as well as the leg and connecting tendons, the sole of shoes designed for such activities typically include several layers, including a resilient, shock absorbent layer such as a midsole and a ground contacting outer sole or outsole which provides both durability and traction.

The typical midsole uses one or more materials or components which affect the force of impact in two important ways, i.e., through shock absorption and energy dissipation. Shock absorption involves the attenuation of harmful impact forces to thereby provide enhanced foot protection. Energy dissipation is the dissemination of both impact and useful propulsive forces. Thus, a midsole with high energy dissipation characteristics generally has a relatively low resiliency and, conversely, a midsole with low energy dissipating characteristics generally has a relatively high resiliency. The optimum midsole should be designed with an impact response that takes into consideration both adequate shock absorption and sufficient resiliency.

One type of sole structure in which attempts have been made to design appropriate impact response are soles, or inserts for soles, that contain a bladder element of either a liquid or gaseous fluid. These bladder elements are either encapsulated in place during the foam midsole formation or dropped into a shallow, straight walled cavity and cemented in place, usually with a separate piece of foam cemented on top. Particularly successful gas filled structures are disclosed in U.S. Pat. Nos. 4,183,156 and 4,219,945 to Marion F. Rudy, the contents of which are hereby incorporated by reference. An inflatable bladder or barrier member is formed of an elastomeric material having a multiplicity of preferably intercommunicating, fluid-containing chambers inflated to a relatively high pressure by a gas having a low diffusion rate through the bladder. The gas is supplemented by ambient air diffusing through the bladder to thereby increase the pressure therein and obtain a pressure that remains at or above its initial value over a period of years. (U.S. Pat. Nos. 4,340,626, 4,936,029 and 5,042,176 to Marion F. Rudy describe various diffusion mechanisms and are also hereby incorporated by reference.)

The pressurized, inflatable bladder insert is incorporated into the insole structure, in the '156 patent, by placement within a cavity below the upper, e.g., on top of a midsole layer and within sides of the upper or midsole. In the '945 patent, the inflatable bladder insert is encapsulated within a yieldable foam material, which functions as a bridging moderator filling in the irregularities of the bladder, providing a substantially smooth and contoured surface for supporting the foot and forming an easily handled structure for attachment to an upper. The presence of the moderating foam, however, detracts from the cushioning and perception benefits of the gas inflated bladder. Thus, when the inflated bladder is encapsulated in a foam midsole, the impact response characteristics of the bladder are hampered by the effect of the foam structure. Referring to FIG. 5 of the '945 patent for example, the cross-section of the midsole shows a series of tubes linked together to form the gas filled bladder. When the bladder is pressurized its tendency is to be generally round in cross-section. The spaces between those bladder portions are filled with foam. Because the foam-filled spaces include such sharp corners, the foam density in the midsole is uneven, i.e., the foam is of higher density in the corners and smaller spaces, and lower density along rounded or flatter areas of the bladder. Since foam has a stiffer response to compression, in the tighter areas with foam concentrations, the foam will dominate the cushioning response upon loading. So instead of a high deflection response, the response can be stiff due to the foam reaction. The cushioning effects of the bladder thus may be reduced due to the uneven concentrations of foam. In addition, the manufacturing techniques used to produce the sole structure formed by the combination of the foam midsole and inflated bladder must also be accommodating to both elements. For example, when encapsulating the inflatable bladder, only foams with relatively low processing temperatures can be used due to the susceptibility of the bladder to deform at high temperatures. The inflated bladder must also be designed with a thickness less than that of the midsole layer in order to allow for the presence of the foam encapsulating material completely therearound. Thus, there are manufacturing as well as performance constraints imposed in the foam encapsulation of an inflatable bladder.

A cushioning shoe sole component that includes a structure for adjusting the impact response of the component is disclosed in U.S. Pat. Nos. 4,817,304 to Mark G. Parker et al. The sole component of Parker et al. is a viscoelastic unit formed of a gas containing bladder and an elastomeric yieldable outer member encapsulating the bladder. The impact resistance of the viscoelastic unit is adjusted by forming a gap in the outer member at a predetermined area where it is desired to have the bladder predominate the impact response. The use of the gap provides an adjustment of the impact response, but the adjustment is localized to the area of the gap. The '304 patent does not disclose a way of tuning the impact response to optimize the response over the time of footstrike through the appropriate structuring of both the bladder and encapsulating material.

A cushioning system for a shoe sole which uses a bladder connected only along its perimeter and supported in an opening in resilient foam material, is disclosed in U.S. Pat. No. 5,685,090 to Tawney et al., which is hereby incorporated by reference. The bladder of Tawney et al. has generally curved upper and lower major surfaces and a sidewall that extends outward from each major surface. The angled sidewalls form a horizontally orientated V-shape in cross-section, which fits into a correspondingly shaped groove in the opening in the surrounding resilient foam material. Portions of the top and bottom of the bladder are not covered with the foam material. By forming the bladder without internal connections between the top and bottom surfaces, and exposing portions of the top and bottom surfaces, the feel of the bladder is maximized. However, the '090 patent does not disclose a way of tuning the impact response through design of both the bladder and foam material.

One type of prior art construction concerns air bladders employing an open-celled foam core as disclosed in U.S. Pat. Nos. 4,874,640 and 5,235,715 to Donzis. These cushioning elements do provide latitude in their design in that the open-celled foam cores allow for a variety of shapes of the bladder. However, bladders with foam core tensile members have the disadvantage of unreliable bonding of the core to the barrier layers. One of the main disadvantages of this construction is that the foam core defines the shape of the bladder and thus must necessarily function as a cushioning member at footstrike which detracts from the superior cushioning properties of air alone. The reason for this is that in order to withstand the high inflation pressures associated with such air bladders, the foam core must be of a high strength which requires the use of a higher density foam. The higher the density of the foam, the less the amount of available air space in the air bladder. Consequently, the reduction in the amount of air in the bladder decreases the benefits of cushioning. Cushioning generally is improved when the cushioning component, for a given impact, spreads the impact force over a longer period of time, resulting in a smaller impact force being transmitted to the wearer's body.

Even if a lower density foam is used, a significant amount of available air space is sacrificed which means that the deflection height of the bladder is reduced due to the presence of the foam, thus accelerating the effect of "bottoming-out." Bottoming-out refers to the failure of a cushioning device to adequately decelerate an impact load. Most cushioning devices used in footwear are non-linear compression based systems, increasing in stiffness as they are loaded. Bottom-out is the point where the cushioning system is unable to compress any further. Compression-set refers to the permanent compression of foam after repeated loads which greatly diminishes its cushioning properties. In foam core bladders, compression set occurs due to the internal breakdown of cell walls under heavy cyclic compression loads such as walking or running. The walls of individual cells constituting the foam structure abrade and tear as they move against one another and fail. The breakdown of the foam exposes the wearer to greater shock forces, and in the extreme, to formation of an aneurysm or bump in the bladder under the foot of the wearer, which will cause pain to the wearer.

Another type of composite construction prior art concerns air bladders which employ three dimensional fabric as tensile members such as those disclosed in U.S. Pat. Nos. 4,906,502, 5,083,361 and 5,543,194 to Rudy; and U.S. Pat. Nos. 5,993,585 and 6,119,371 to Goodwin et al., which are hereby incorporated by reference. The bladders described in the Rudy patents have enjoyed commercial success in NIKE, Inc. brand footwear under the name Tensile-Air®. Bladders using fabric tensile members virtually eliminate deep peaks and valleys. In addition, the individual tensile fibers are small and deflect easily under load so that the fabric does not interfere with the cushioning properties of air.

One shortcoming of these bladders is that currently there is no known manufacturing method for making complex-curved, contoured shaped bladders using these fabric fiber tensile members. The bladders may have different levels, but the top and bottom surfaces remain flat with no contours and curves.

Another disadvantage is the possibility of bottoming-out. Although the fabric fibers easily deflect under load and are individually quite small, the sheer number of them necessary to maintain the shape of the bladder means that under high loads, a significant amount of the total deflection capability of the air bladder is reduced by the volume of fibers inside the bladder and the bladder can bottom-out.

One of the primary problems experienced with the fabric fibers is that these bladders are initially stiffer during initial loading than conventional air bladders. This results in a firmer feel at low impact loads and a stiffer "point of purchase" feel that belies their actual cushioning ability. The reason for this is because the fabric fibers have a relatively low elongation to properly hold the shape of the bladder in tension, so that the cumulative effect of thousands of these relatively inelastic fibers is a stiff feel. The tension of the outer surface caused by the low elongation or inelastic properties of the tensile member results in initial greater stiffness in the air bladder until the tension in the fibers is broken and the effect of the air in the bladder can come into play.

Another category of prior art concerns air bladders which are injection molded, blow-molded or vacuum-molded such as those disclosed in U.S. Pat. No. 4,670,995 to Huang; U.S. Pat. No. 4,845,861 to Moumdjian; U.S. Pat. Nos. 6,098,313, 5,572,804, and 5,976,541 to Skaja et al.; and U.S. Pat. No. 6,029,962 to Shorten et al. These manufacturing techniques can produce bladders of any desired contour and shape including complex shapes. A drawback of these air bladders can be the formation of stiff, vertically aligned columns of elastomeric material which form interior columns and interfere with the cushioning benefits of the air. Since these interior columns are formed or molded in the vertical position and within the outline of the bladder, there is significant resistance to compression upon loading which can severely impede the cushioning properties of the air.

Huang '995 teaches forming strong vertical columns so that they form a substantially rectilinear cavity in cross section. This is intended to give substantial vertical support to the air cushion so that the vertical columns of the air cushion can substantially support the weight of the wearer with no inflation (see '995, Column 5, lines 4–11). Huang '995 also teaches the formation of circular columns using blow-molding. In this prior art method, two symmetrical rod-like protrusions of the same width, shape and length extend from the two opposite mold halves to meet in the middle and thus form a thin web in the center of a circular column (see Column 4, lines 47–52, and depressions 21 in FIGS. 1–4, 10 and 17). These columns are formed of a wall thickness and dimension sufficient to substantially support the weight of a wearer in the uninflated condition. Further, no means are provided to cause the columns to flex in a predetermined fashion, which would reduce fatigue failures. Huang's columns 42 can be prone to fatigue failure due to compression loads, which force the columns to buckle and fold unpredictably. Under cyclic compression loads, the buckling can lead to fatigue failure of the columns.

Prior art cushioning systems which incorporate an air bag or bladder can be classified into two broad categories: cushioning systems which focused on the design of the bladder and its response characteristics; and cushioning systems which focused on the design of the supporting mechanical structure in and around the bladder.

The systems that focused on the air bladder itself dealt with the cushioning properties afforded by the pneumatics of the sealed, pressurized bladder. The pneumatic response is a desirable one because of the large deflections upon loading which corresponds to a softer, more cushioned feel, and a smooth transition to the bottom-out point. Potential drawbacks of a largely pneumatic system may include poor control of stiffness through compression and instability. Control of stiffness refers to the fact that a solely pneumatic system will exhibit the same stiffness function upon loading. There is no way to control the stiffness response. Instability refers to potential uneven loading and potential shear stresses due to the lack of structural constraints on the bladder upon loading.

Pneumatic systems also focused on the configuration of chambers within the bladder and the interconnection of the chambers to effect a desired response. Some bladders have become fairly complex and specialized for certain activities and placements in the midsole. The amount of variation in bladder configurations and their placement have required stocking of dozens of different bladders in the manufacturing process. Having to manufacture different bladders for different models of shoes adds to cost both in terms of manufacture and waste.

Certain prior pneumatic systems generally used air or gas in the bladder at pressures substantially above ambient. To achieve and maintain pressurization, it has been necessary to employ specially designed, high-cost barrier materials to form the bladders, and to select the appropriate gas depending on the barrier material to minimize the migration of gas through the barrier. This has required the use of specialty films and gases such as nitrogen or sulfur hexafluoride at high pressures within the bladders. Part and parcel of high pressure bladders filled with gases other than air or nitrogen is added requirement to protect the bladders in the design of the midsole to prevent rupture or puncture.

The prior art systems which focused on the mechanical structure by devising various foam shapes, columns, springs, etc., dealt with adjusting the properties of the foam's response to loading. Foam provides a cushioning response to loading in which the stiffness function can be controlled throughout and is very stable. However, foam, even with special construction techniques, does not provide the large deflection upon loading that pneumatic systems can deliver.

SUMMARY OF THE INVENTION

The present invention pertains to a sole component for footwear incorporating a sealed, fluid containing chamber and resilient material to harness the benefits of both a pneumatic system and a mechanical system, i.e., provide a large deflection at high impact, controlled stiffness response, a smooth transition to maximum deflection and stability. The sole component of the present invention is specifically designed to optimally combine pneumatic and mechanical structures and properties. The sealed, fluid containing chamber can be made by sealing an appropriately shaped void in the resilient material, or forming a bladder of resilient barrier material.

Recognizing that resilient material, such as a foamed elastomer, and air systems each posses advantageous properties, the present invention focuses the design of cushioning systems combining the desirable properties of both types, while reducing the effect of their undesirable properties.

Foamed elastomers as a sole cushioning material possesses a very desirable material property: progressively increasing stiffness. When foamed elastomers are compressed the compression is smooth as its resistance to compression is linear or progressive. That is, as the compression load increases, foamed elastomers become or feel increasingly stiff. The high stiffness allows the foamed elastomers to provide a significant contribution to a cushioning system. The undesirable properties of foamed elastomers include limitations on deflection by foam density, quick compression set, and limited design options.

Gas filled chambers or bladders also possess very desirable properties such as high deflection at impact and a smooth transition to bottom-out. The soft feel of a gas filled bladder upon loading is the effect of high deflection, which demonstrates the high energy capacity of a pneumatic unit. Some difficulties of designing gas filled bladder systems include instability and the need to control the geometry of the bladder. Pressurized bladders by their very nature tend to take on a shape as close to a ball, or another round cross-section, as possible. Constraining this tendency can require complex manufacturing methods and added elements to the sole unit.

In the past these two types of structures were used together but were not specifically designed to work together to exhibit the best properties of each system while eliminating or minimizing the drawbacks.

This is now possible due to the specially designed single chamber, pear-shaped, or taper-shaped bladder that can be used in a variety of locations and configurations in a midsole. The tapered shape has at least one planar major surface and a contoured surface, which is contoured from side to side and front to back. This contoured surface, when used with a resilient material, such as a foamed elastomer, provides a smooth stiffness transition from the resilient material to the bladder and vice-versa. The single chamber tapered bladder can be used in a variety of locations and configurations in a midsole to provide desired response characteristics. Only one bladder shape is required to be stocked which will significantly reduce manufacturing costs.

The present invention provides the best of pneumatic and mechanical cushioning properties without high pressurization of the air bladder. The air bladder used in the present invention is simply sealed with air at ambient pressure or at a slightly elevated pressure, within 5 psi (gauge) of ambient, and does not require nitrogen or specialized gases. Since the bladder is pressurized to a very low pressure if at all, the air bladder of the present invention also does not require a special barrier material. Any available barrier material can be used to make the bladder, including recycled materials which presents another substantial cost advantage over conventional pressurized bladders. Against the prevailing norm of pressurization, the cushioning system of the present invention is engineered to provide sufficient cushioning with an air bladder sealed at ambient pressure.

The single chamber air bladder of the present invention can be formed by blow-molding or vacuum forming with the bladder sealed from ambient air at ambient pressure or at slightly elevated pressure. Because high pressurization is not required, the additional manufacturing steps of pressurizing and sealing a pressurized chamber are not required. Minimizing complexity in this way will also be less expensive resulting in a very cost-effective system that provides all of the benefits of more expensive specially designed pneumatic systems.

When a cushioning system is loaded, the desired response is one of large deflection at initial load or strike to absorb the shock of the greatest force, and a progressively increasing stiffness response to provide stability through the load. The overall stiffness is controlled primarily by the density or hardness of the resilient material—the foam density or hardness when a foamed elastomer is used. Because of the smoothly contoured transition areas of the foam material and air bladder interface, foam densities are even and high concentrations are eliminated. The gentle slopes and contours of the tapered air bladder provide gradual transitions between the foam material and air bladder responses. Thus, because of the shape of the air bladder, the response to a load can be controlled by its placement. Placing the tapered, for example, pear-shaped air bladder at ambient or very low pressure under the area of greatest force of the wearer's foot affords greater deflection capacity than current systems, which employ high pressurization. This is due to the relatively large volume of the tapered air bladder, in combination with the lack of internal connections or structure within the interior area of the bladder, allowing for a relatively large deflection upon load. For example, when the pear shape is used, the larger, more bulbous end of the pear shaped bladder will deflect more than the narrower end. With this parameter in mind, rotation and movement of the air bladder can provide very different cushioning characteristics, which can mimic the effect of more complex and expensive foam structures within a midsole. In this way the air bladder and foam material work in concert to provide the desired response.

These and other features and advantages of the invention may be more completely understood from the following detailed description of the preferred embodiments of the invention with reference to the accompanying drawings.

DETAILED DESCRIPTION OF THE INVENTION

Sole 10 of the present invention includes a midsole 12 of an elastomer material, preferably a resilient foam material and one or more air bladders 14, 16 disposed in the midsole. FIGS. 1–4 illustrate a cushioning system with a bladder 14 disposed in the heel region and a bladder 16 disposed in the metatarsal head region, the areas of highest load during footstrike. The bladders are used to form sealed chambers of a specific shape. In an alternate embodiment a sealed chamber can be formed from a void in an elastomeric chamber that is sealed with a separate cover material. The shape of the chambers and their arrangement in the elastomeric material, particularly in the heel region, produces the desired cushioning characteristics of large deflection for shock absorption at initial footstrike, then progressively increasing stiffness through the footstrike.

Figure 7:
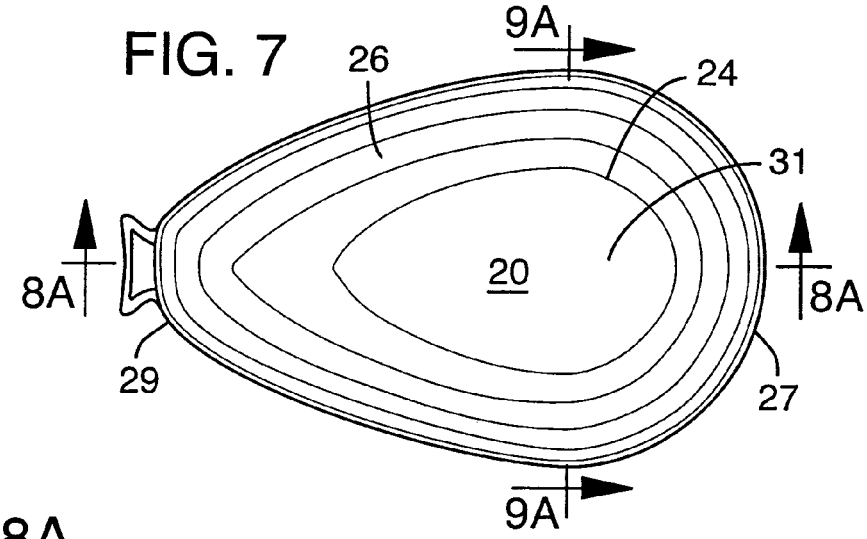
FIG. 7 is a bottom plan view of the air bladder of FIG. 5.

The preferred shape of the bladder is a contoured taper shaped outline, preferably pear-shaped, as best seen in FIGS. 5–14. This shape was determined by evaluating pressures exerted by the bottom of a wearer's foot. The shape of the air bladder matches the pressure map of the foot, wherein the higher the pressure, the higher the air-to-foam depth ratio. The shape of the outline is defined by the two substantially planar major surfaces in opposition to one another and in generally parallel relation: a first major surface 18 and a second major surface 20. These surfaces each have a perimeter border 22, 24 respectively which define the shape of the bladder so that bladder 14 has a larger rounded end 27 and tapers to a more pointed narrow end 29. Narrow end 29 has a width substantially less than the maximum width of larger rounded end 27 so that major surfaces 18 and 20 take on a generally pear-shaped outline. Second major surface 20 has substantially the same outline as first major surface 18 but is smaller in surface area by approximately 50%. At the rounded end 27 of the bladder, first major surface 18 and second major surface 20 are only slightly offset as seen in FIGS. 7–8. At narrow end 29 of the bladder, the point of second major surface 20 is further apart from the corresponding point of first major surface 18 than at the rounded end. First major surface 18 and second major surface 20 are symmetric about a longitudinal center line 31 of the bladder. These major surfaces are connected together by a contoured sidewall 26, which extends around the entire bladder. Sidewall 26 is preferably integral with first major surface 18 and second major surface 20, and if the bladder is formed of flat sheets, i.e., vacuum molded, a substantial portion of sidewall 26 is formed from the same sheet making up second major surface 20. Even in a blow-molded bladder, the seam is located such that the sidewall appears to be formed on the same side of the seam as the second major surface.

Figure 8A:
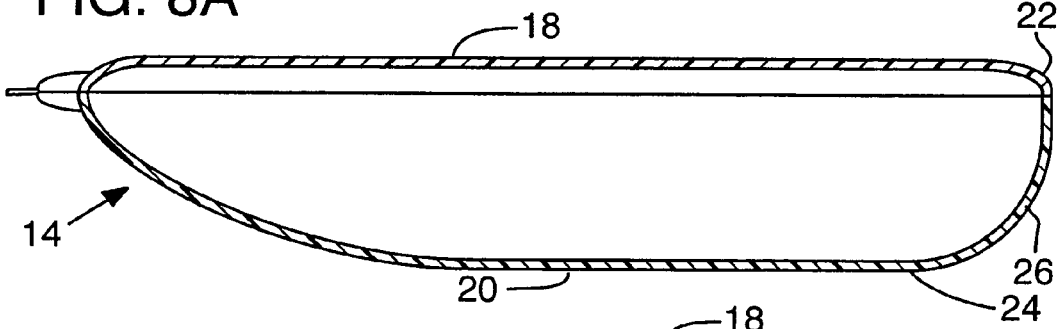
FIG. 8A is a cross-section taken along line 8—8 of FIG. 7.
Figure 9A:
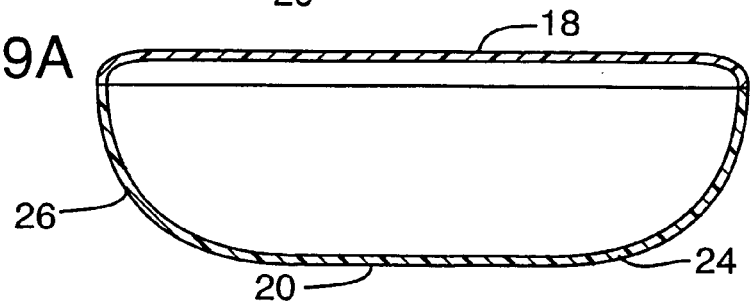
FIG. 9A is a cross-section taken along line 9—9 of FIG. 7.

As best seen in FIGS. 7, 8A and 9A, the longitudinal spacing between the rounded end of second major surface 20 and the rounded end of first major surface 18 is less than the longitudinal spacing between the pointed end of second major surface 20 and the pointed end of first major surface 18. This distance is covered in a contoured manner by sidewall 26 as best seen in FIGS. 5–9A so as to provide a long, smoothly sloped contour at the pointed end of the bladder and a shorter, smoothly sloped contour at the rounded end. This results in a bladder that has a substantially flat side where major surface 18 is disposed, and a substantially convex side where major surface 20 is disposed. Bladder 14 has one axis of symmetry, i.e., the longitudinal axis, and is asymmetrical in all other aspects. This seemingly simple, articulated shape of the air bladder provides a multitude of possible variations depending on the desired cushioning response to load. Also as seen in the Figures, the major surfaces are connected to one another only by the sidewalls. The major surfaces are devoid of any internal connections.

Figure 1:
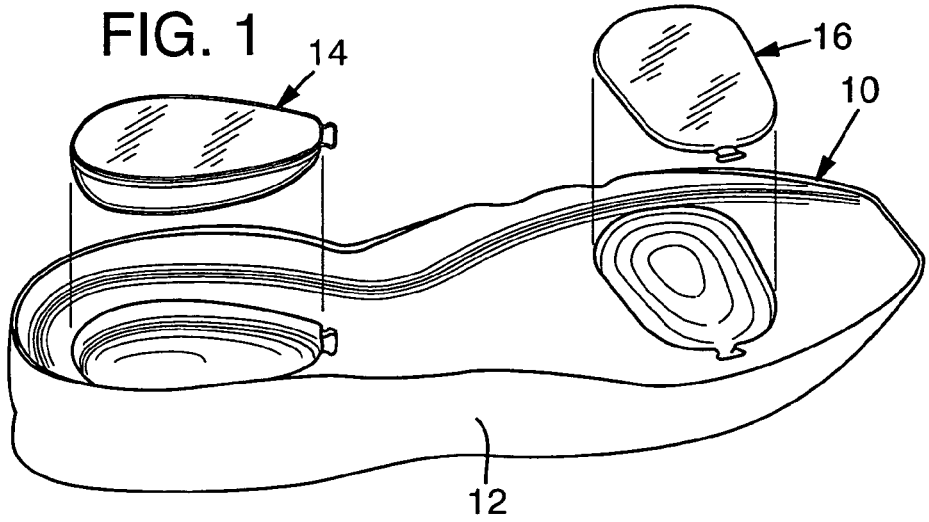
FIG. 1 is an exploded perspective view of a footwear sole in accordance with the present invention showing air bladders placed in the heel and metatarsal head areas.
Figure 2A:
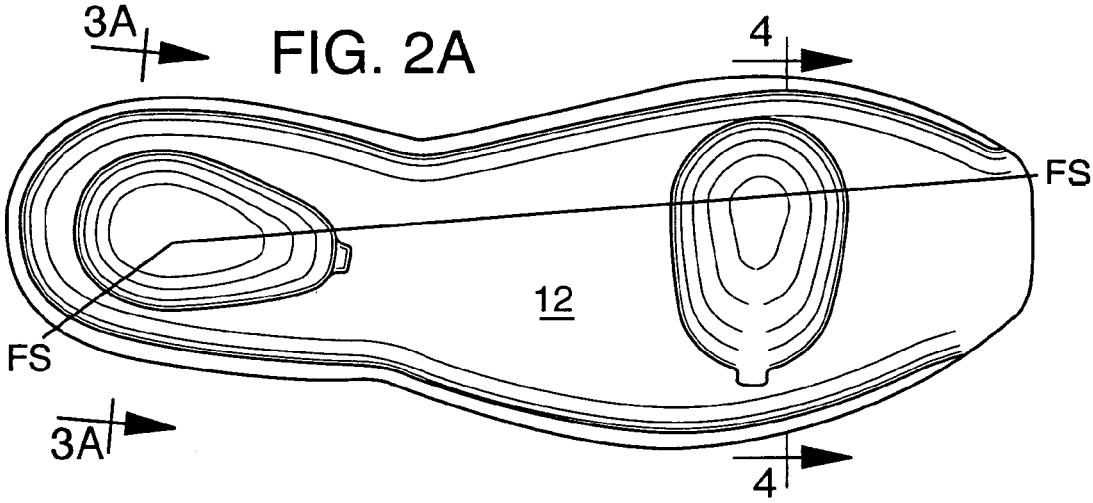
FIG. 2A is a top plan view of the sole of FIG. 1 shown with the air bladders positioned in the foam midsole material.
Figure 3A:
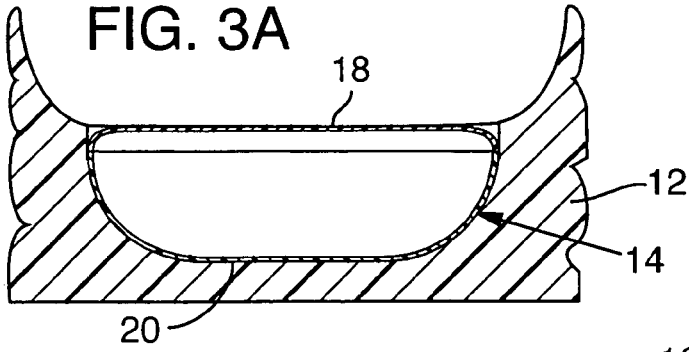
FIG. 3A is a cross-section taken along line 3A—3A of FIG. 2A.
Figure 4:
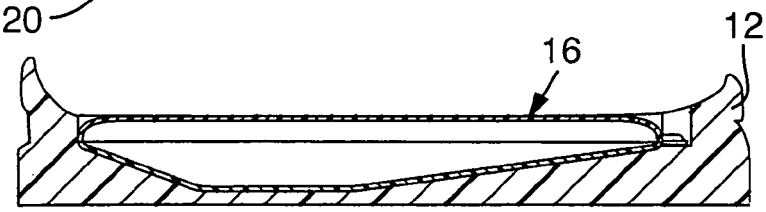
FIG. 4 is a cross-section taken along line 4—4 of FIG. 2A.
Figure 2B:
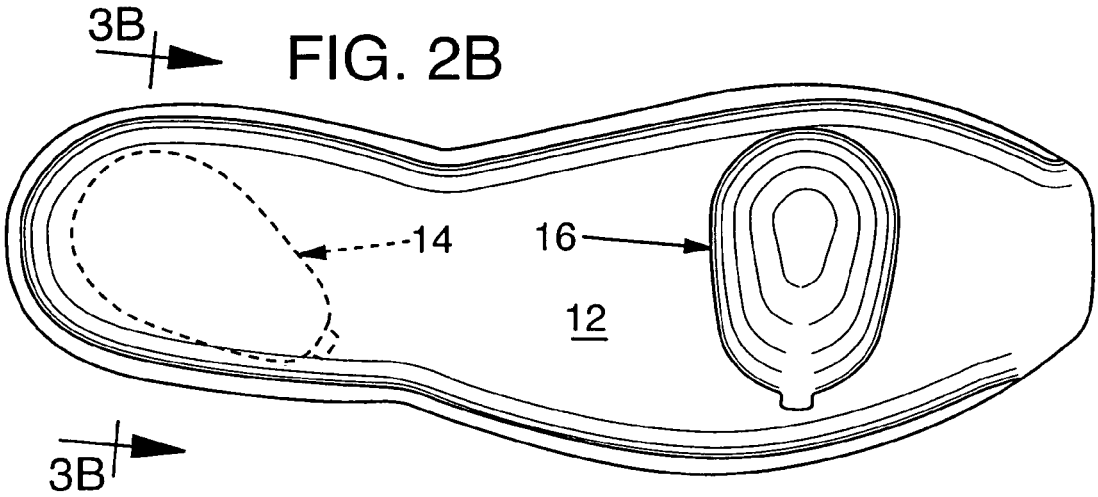
FIG. 2B is a top plan view of an alternative embodiment of the footwear sole of FIG. 1 in which an air bladder is rotated in its orientation to provide a specific response.

As seen in FIGS. 1, 2A–B and 3A–B, the orientation of the bladder in the foam material can be varied to attain differing cushioning properties. Air bladder 14 can be oriented in the resilient foam material with its longitudinal axis generally aligned with the longitudinal axis of the midsole as shown in FIG. 2A, which will provide overall cushioning and lateral support for a wide range of wearers. Alternatively, air bladder 14 can be oriented with its longitudinal axis rotated with respect to the longitudinal axis, toward the lateral side, of the midsole as shown in FIG. 2B. With the bladder rotated in this manner, more foam material is present in the medial side of the midsole thereby creating a simulated medial post since the foam material will dominate the response to a load in the medial portion and thereby feel stiffer than the response in the lateral side which will be dominated by the air bladder's deflection. More support is provided on the medial side to stabilize the medial side of the sole and inhibit over-pronation during footstrike. By adjusting the orientation of the air bladder in this manner, the response characteristics of the cushioning system can be customized. The orientations shown in FIGS. 2A and 2B are intended to be exemplary, and other orientations are contemplated to be within the scope of the invention.

Another possible adjustment to the air bladder's orientation is the determination of which side of the air bladder faces upward. When bladder 14 is positioned in resilient foam material 12 in the orientation shown in FIGS. 1 and 3A, the convex side of the bladder is cradled in the foam, and the flat side faces upward and is not covered with foam, thereby providing more cushioning, i.e. greater deflection of the bladder, and a smooth transition from the feel of the bladder to the stiffer feel of the foam upon loading. The orientation of FIG. 3A in which the mostly planar surface of the bladder is loaded, is referred to herein as the top loaded condition.

Figure 3B:
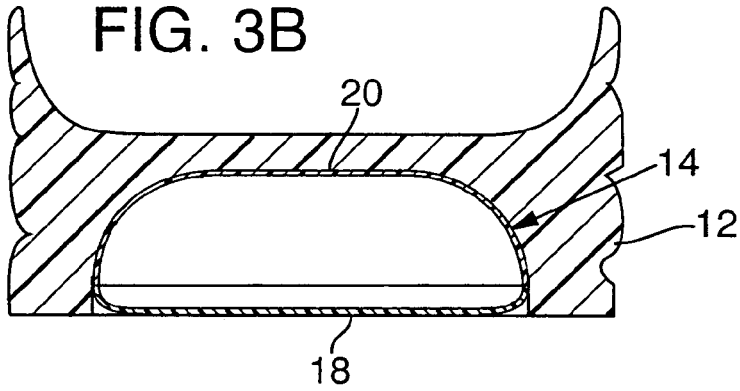
FIG. 3B is a cross-section taken along line 3B—3B of FIG. 2B.
Figure 6:
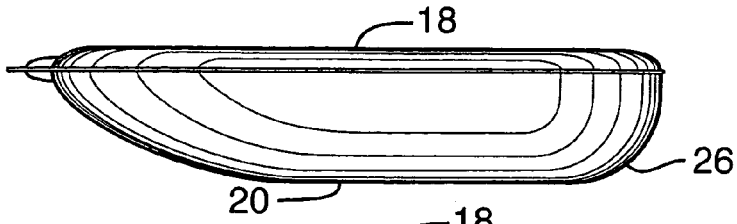
FIG. 6 is an end elevation view of the air bladder of FIG. 5.
Figure 5:
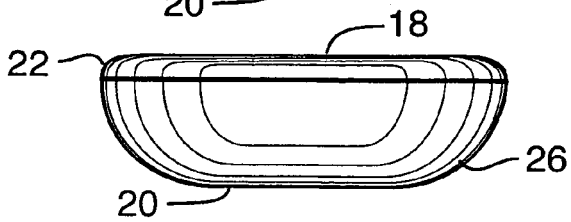
FIG. 5 is a side elevational view of the heel air bladder shown in the top-load configuration.

It is possible to turn bladder 14 over and orient it in the foam so that the substantially flat side, containing major surface 18, faces downward and the convex side, containing major surface 20, faces upward, FIG. 3B, so that a foam material arch above the bladder takes the load. This orientation is referred to herein as the bottom loaded condition in which a layer of foam material is disposed over the convex side of the bladder. The bottom loaded condition provides a stiffer response than the top loaded condition since more foam material is present between the heel and the bladder to moderate the feel of the bladder's deflection. Additionally, a structural arch is formed. This results in a stronger support for the heel region during footstrike.

Similarly, air bladder 16 which is illustrated to be in the metatarsal head region of the midsole affords different cushioning properties depending on its orientation. Air bladder 16 also has a first major surface 28, which is generally planar, and a second major surface 30, which is also generally planar and is smaller in surface area than first surface 28. The second surface has a surface area approximately 25% to 40% of the surface area of the first surface. These surfaces are generally parallel to one another and are defined by first perimeter border 32 and second perimeter border 34 which are connected by a sidewall 36, similar to sidewall 26 of air bladder 14. Because of the relatively small size of second surface 30, sidewall 36 has a relatively flat slope, in other words, when placed in resilient foam material the transition from air bladder to foam response is very gradual with air bladder 16.

Air bladder 16 is shown placed in the resilient foam midsole in a top loaded configuration, but as with air bladder 14, it could be turned over to provide a different response to load. The orientation of air bladder 16 with its longitudinal axis aligned with the direction of the metatarsal heads of a wearer as shown in FIG. 2A will provide the desired cushioning response for a wide variety of wearers. However, the orientation can be rotated as explained above to achieve customized responses.

The line FS in FIG. 2A, which will be referred to as footstrike line FS, illustrates the line of maximum pressure applied by the foot of a wearer to a shoe sole during running by a person whose running style begins with footstrike in the lateral heel area (rear foot strikers). The line FS is a straight line generalization of the direction that the line of maximum pressure follows for rearfoot strikers. The actual line of pressure for a given footstrike would not be precisely along straight line FS, but would generally follow line FS. As seen in this Figure, footstrike line FS starts in the lateral heel area, proceeds diagonally forward and towards the medial side as it proceeds through the heel area (pronation), turns in a more forward direction through the forward heel and arch areas, and finally proceeds through the metatarsal, metatarsal head and toe areas, with the foot leaving the ground (toe off) adjacent the area of the second metatarsal head.

Figure 8B:
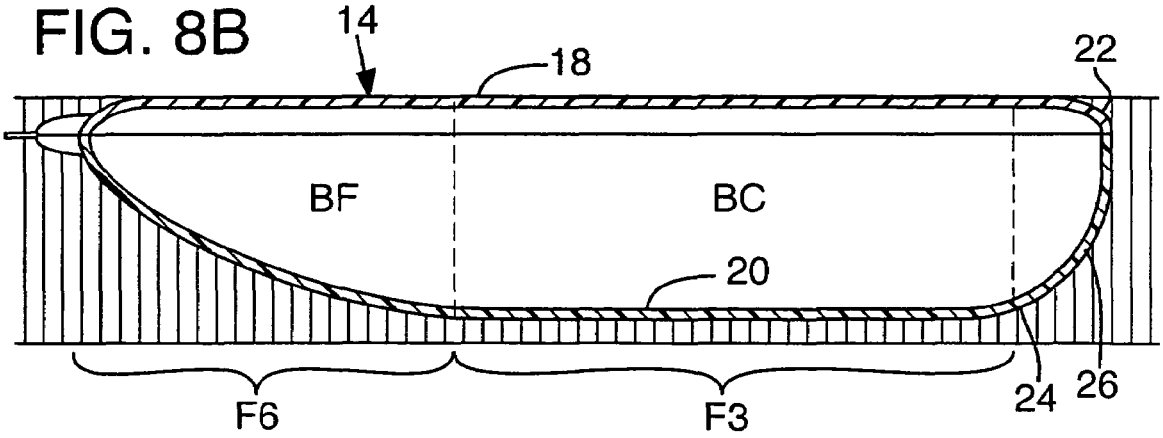
FIG. 8B is a cross-section similar to that of FIG. 8A and shown with a representation of midsole foam material to illustrate the smooth transition of stiffness during footstrike.
Figure 9B:
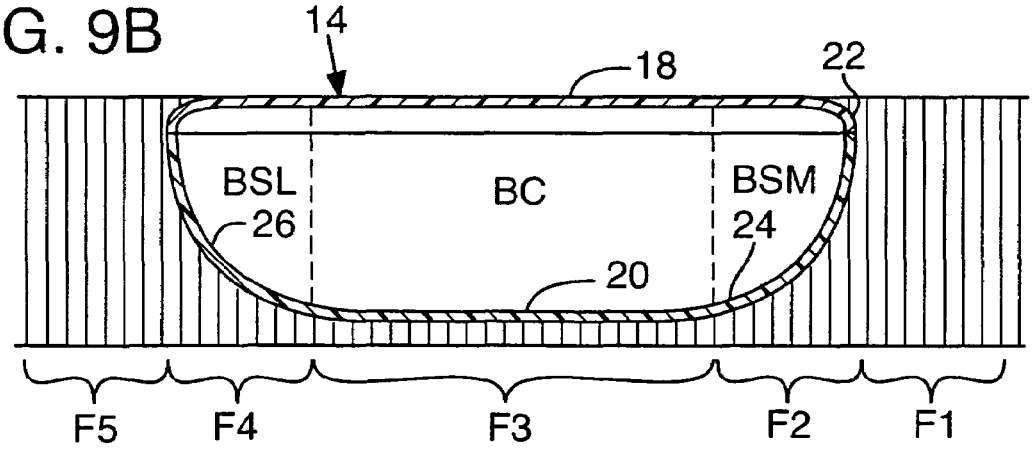
FIG. 9B is a cross-section similar to that of FIG. 9A and shown with a representation of midsole foam material to illustrate the smooth transition of stiffness during footstrike.
Figure 10:
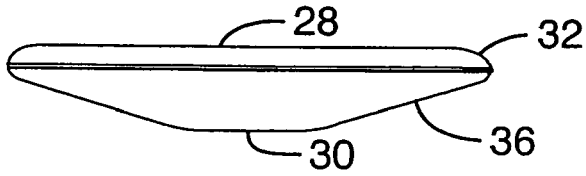
FIG. 10 is a side elevational view of the calcaneus air bladder shown in the top-load configuration.
Figure 11:
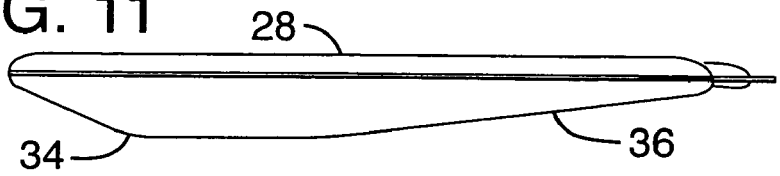
FIG. 11 is an end elevation view of the air bladder of FIG. 10.
Figure 12:
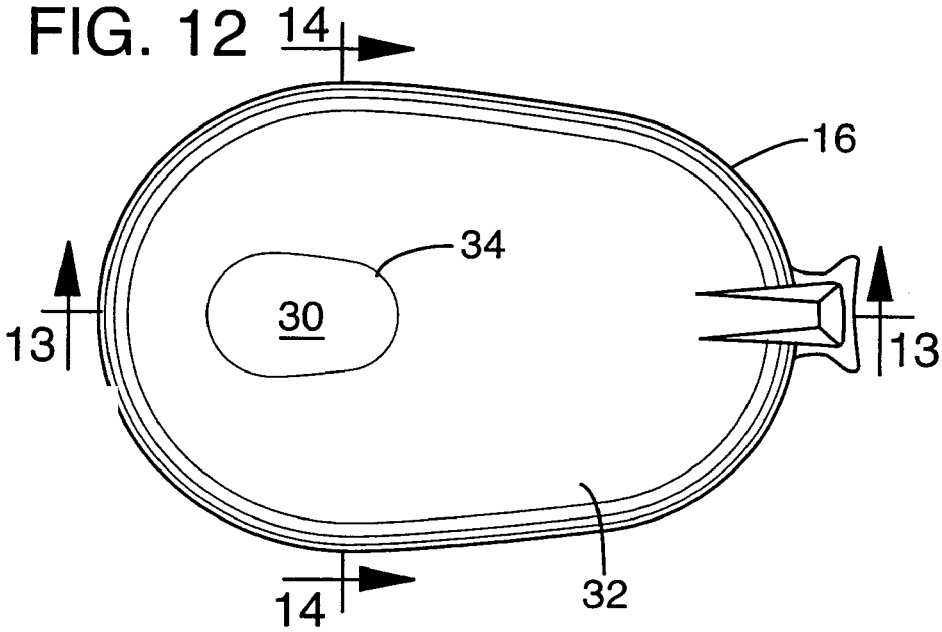
FIG. 12 is a bottom plan view of the air bladder of FIG. 10.
Figure 13:
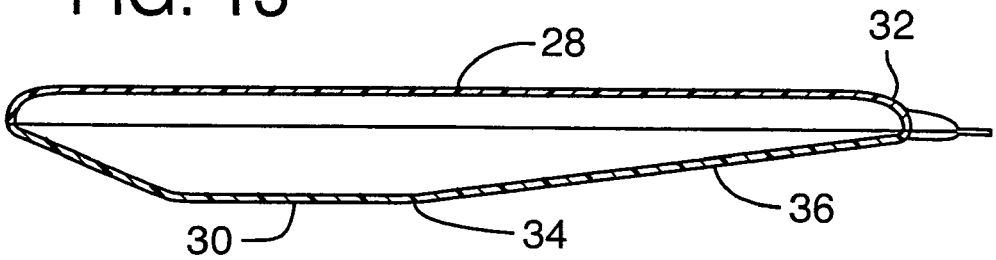
FIG. 13 is a cross-section taken along line 13—13 of FIG. 12.
Figure 14:
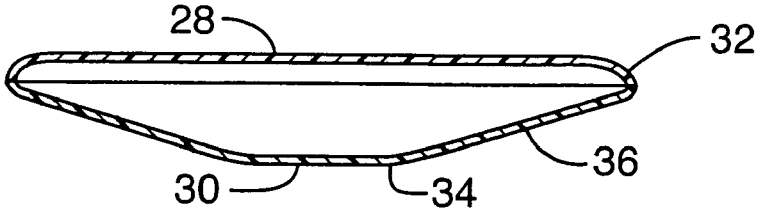
FIG. 14 is a cross-section taken along line 14—14 of FIG. 12.

FIGS. 8B and 9B illustrate how the midsole foam material and the shape of bladder 14 accomplishes smooth transition of stiffness as the foot of the wearer proceeds through footstrike in the heel area towards the forefoot. At initial footstrike, the foot contacts the rear lateral heel area where the midsole is formed entirely of foam material (F1) to provide a firm, stable, yet shock-absorbing effect. As footstrike proceeds medially and forwardly, the amount of foam material (F2) underlying the foot gradually decreases and the thickness of bladder 14 gradually increases because of the smooth, sloped contour of sidewall 26 in the medial side area (BSM). In this area, the effect of the more compliant bladder 14 gradually takes greater effect for shock absorbing and gradually decreasing the stiffness of the midsole, until an area of maximum bladder thickness and minimum foam thickness (F3) is reached. The maximum bladder thickness occurs in the side-to-side center area (BC) of bladder 14, which underlies the calcaneous of the foot. In this manner, maximum deflection of bladder 14, minimum stiffness and maximum shock attenuation is provided under the calcaneous.

As footstrike proceeds medially past center area BC, sidewall 26 has a smooth contour that decreases the thickness of bladder 14 in the lateral side area (BSL) of the bladder so that the thickness of the foam (F4) gradually increases to again provide a smooth transition from the more compliant effect of bladder 14 to the more stiff, supportive effect of the foam material. When footstrike reaches the medial side of the front heel area, the full thickness of foam F5 is reached to provide the maximum supportive effect of the foam material. As seen by comparing FIG. 2A to FIG. 2B, the supportive effect of the foam material in the medial heel front area can be maximized by angling the front bladder 14 toward the lateral side as shown in FIG. 2B. Such angling places more foam material, as compared to bladder 14 in FIG. 2A, in the medial front heel area. This orientation is preferred for a shoe designed to restrict over-pronation during running.

A smooth transition from the effect of the bladder to the effect of the foam material also occurs as footstrike proceeds forward from the rear heel area toward the forefoot area. This transition is accomplished in a similar manner to the transition from the medial to lateral direction by smoothly sloping the forward sidewall of bladder 14 in the forward bladder area BF, and by reducing the overall width of bladder 14 as it extends from its larger rounded end 27 to its more pointed narrow end 29. In this manner, the thickness of bladder 14 gradually decreases and the thickness of the foam material F6 gradually increases until the full thickness of the foam material is reached in front of bladder 14.

Figure 16A:
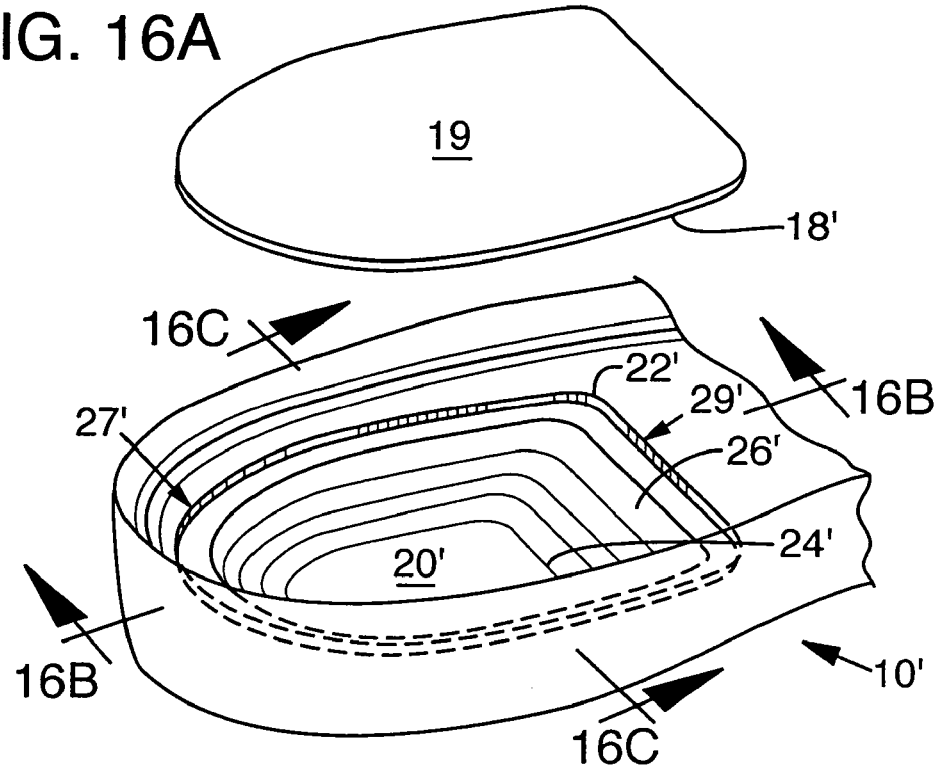
FIG. 16A is an exploded perspective view of another embodiment of a heel chamber in accordance with the present invention.
Figure 16B:
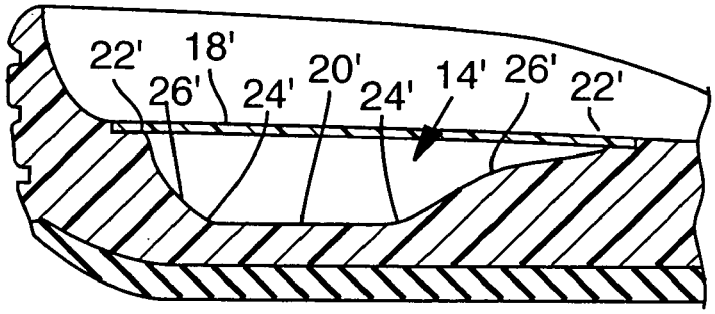
FIG. 16B is a cross-section taking along line 16B—16B of FIG. 16A, with the heel chamber sealed.
Figure 16C:
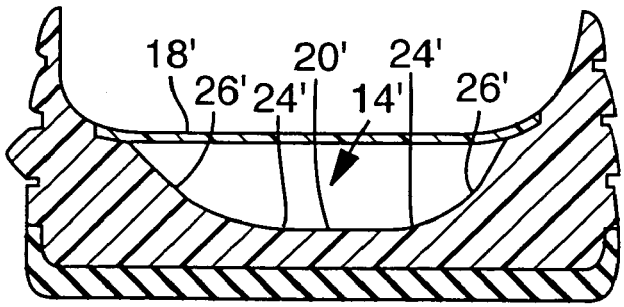
FIG. 16C is a cross-section taken along line 16C—16C of FIG. 16A, with the heel chamber sealed.

An alternative method of making the cushioning component is to mold the resilient material, such as a foam elastomer, with a void in the shape of the taper shaped bladder and sealing off the void to form a sealed chamber. Any conventional molding technique can be used, such as injection molding, pour molding, or compression molding. Any moldable thermoplastic elastomer can be used, such as ethylene vinyl acetate (EVA) or polyurethane (PU). This alternative method, as well as an alternative configuration for the sealed chamber within the foam material is illustrated in FIGS. 16A, 16B, and 16C. When a foam elastomer is molded with an insert to provide the void, the foam surrounding the insert will flow and form a skin during the molding process. At the conclusion of the molding process the insert is removed, and the opening which allowed removal of the insert is sealed, such as by the attachment of the outsole, a lasting board, or another piece of resilient material, such as a sheet of thermoplastic urethane 19, as illustrated in FIGS. 16A–C. The skin formed from the molding process acts like air bladder material and seals the air in the void, without the need for a separate air bladder. If a closed cell foam material is used, skin formation would not be required. The sealed chamber provides a comparable cushioning effect as having an ambient air filled air bladder surrounded by the foam. This manufacturing method is economical as no air bladder materials are required. Also, the step of forming the separate air bladder is eliminated.

As seen in FIGS. 16A to 16C, an alternate sealed chamber 14' is configured for use in the heel area of sole 10'. As with bladder 14, sealed chamber 14' has a contoured tapered shape, and is orientated in the heel area to match with the pressure map of the foot, wherein the higher the pressure, the higher the air to foam depth ratio. Sealed chamber 14' has two substantially planar major surfaces in opposition to one another and in a generally parallel relation: a first major surface 18' and a second major surface 20'. These surfaces each have a perimeter border 22', 24', respectively, which define the shape of the bladder so that bladder 14 has a first rounded end 27' and tapers slightly to a flat end 29'. A contoured sidewall 26' connects the major surfaces between their respective perimeters 22' and 24'.

Sealed chamber 14' accomplishes smooth stiffness transition from the lateral to medial direction, and from the rear to forward direction in a manner similar to bladder 14. Comparing FIGS. 9B and 16C, it is seen that a slope contour from bottom surface 24' and along sidewalls 26' is similar on both the medial and lateral sides of sealed chamber 14' as with bladder 14. Thus, proceeding from heel strike in the lateral rear area and moving towards the medial rear area, the smooth transition of stiffness described above is accomplished. Since the perimeter borders 22' and 24' do not taper inwardly as much as the perimeter borders of bladder 14, smooth stiffness transition proceeding from the rear of sealed chamber 14' forward is accomplished by varying the slope from bottom surface 20' forward along sidewall 26' in a manner different from bladder 14. As seen in FIG. 16B, the bottom of sealed chamber 14' tapers upwardly at a greater rate in the forward direction, from bottom surface 20' through sidewall 26' than the upward taper of the bottom in bladder 14, as seen in FIG. 8B. The more rapid upward taper compensates for the lack of narrowing of sealed chamber 14', so as to increase the amount of foam material underlying the bladder as foot strike moves in the forward direction in a proper gradual rate.

Stiffness can be controlled by adjusting the orientation of the air bladders. For instance, placing the air bladders directly under the calcaneus in the top loaded orientation results in less initial stiffness during footstrike and more later stiffness than when the bladder is placed under the calcaneus in the bottom loaded orientation with foam between the calcaneus and the bladder. Overall stiffness response is controlled primarily by material density or hardness. For the top loaded configuration, increasing foam density or hardness increases the latter stiffness. For the bottom load condition, increasing foam density or hardness increases the middle and latter stiffness. The stiffness slope is also determined by volume, with large air bladders having lower stiffness and therefore more displacement upon loading. This is due to the larger air volume in a single chamber allowing a gradual pressure increase as the bladder volume decreases during compression. Overall stiffness can also be adjusted by varying the size of the larger first major surface 18, 18'. As will be discussed later, as pressure is applied to the bladder or sealed chamber, the exposed major surface 18, 18' undergoes tensioning. If the area of the major surface 18, 18' is increased, the amount of tension the surface undergoes decreases so that stiffness also decreases.

A preferred foam material to use is a conventional PU foam with a specific gravity or density in the range of 0.32 to 0.40 grams/cm$^3$, preferably 0.36 grams/cm$^3$. Another preferred foam material is conventional EVA with a hardness in the range of 52 to 60 Asker C, preferably 55 Asker C. Alternatively, a solid elastomer, such as urethane or the like, could be used if the solid elastomer is compliant or shaped to be compliant. Another material property relevant to the sole construction is the tensile stress at a given elongation of the elastomeric material (modulus). A preferred range of tensile stress at 50% elongation is between 250 and 1350 psi.

When bladder 14, or sealed chamber 14', is incorporated in the heel area of a midsole an appropriate amount of shock attenuation is provided when the open internal volume of the chamber is between about 10 cubic centimeters and 65 cubic centimeters. For such bladders, the substantially flat major surfaces 18, 18' could be in the range of about 1,200 $mm^2$ to 4,165 $mm^2$. For example, when a bladder with a volume of 36 cubic centimeters is used, the pressure ranges from ambient 0 psi to 35 psi when bladder 14 is compressed to 95% of its original volume.

Another advantage of the sole structure of the present invention is the manner in which bladder 14 accomplishes smooth, progressive stiffening by the combination of film tensioning and pressure ramping. Enhanced shock attenuation is also accomplished by minimizing the structure under the areas of greatest pressure to allow for greater maximum deflection while the bag is progressively stiffening. FIGS. 17A through 17D illustrate the film tensioning and pressure ramping in the chamber devoid of internal connections.

Figure 17A:
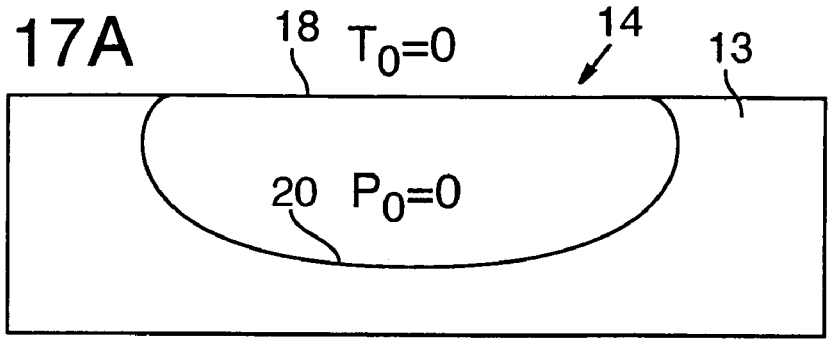
FIG. 17A is a diagrammatic cross-section of a sealed chamber illustrating film tensioning and internal pressure when no force is applied to the sealed chamber.

FIG. 17A diagrammatically illustrates bladder or sealed chamber 14 within an elastomeric material 13. Bladder 14 has a flat primary surface 18 and a secondary major surface 20 with its tapered sides. In FIG. 17A, no pressure is applied to the bladder and the tension $T_0$ along primary surface 18 is zero. The pressure inside the bladder likewise is ambient and for ease of reference will be indicated as $P_0$ being zero.

Figure 17B:
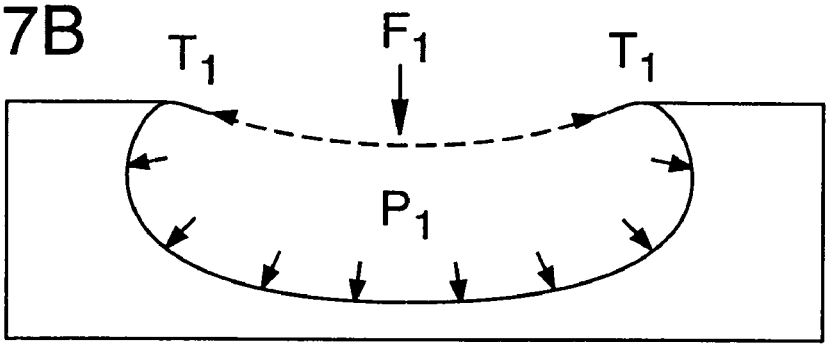
FIG. 17B is a diagrammatic cross-section of a sealed chamber illustrating film tensioning and internal pressure when light force is applied to the sealed chamber.

FIG. 17B diagrammatically illustrates a small amount of force being applied to bladder 16. For example, a person standing at rest and an external force $F_1$ representing the external force applied by a calcaneous of the heel to bladder 14. As seen in this FIG. 17B, force $F_1$ causes primary surface 18 to bend downward a certain degree, reducing the volume within bladder 14, and thereby increasing the pressure to a pressure $P_1$. The bowing of primary surface 18 also causes tension in primary surface 18 to increase to $T_1$. While not illustrated in these diagrams, material 13 also compresses when forces $F$–$F_3$ are applied. The combination of increasing pressure within bladder 16 and the compression of the foam material 13 by the downward force helps to stabilize the foam material walls.

Figure 17C:
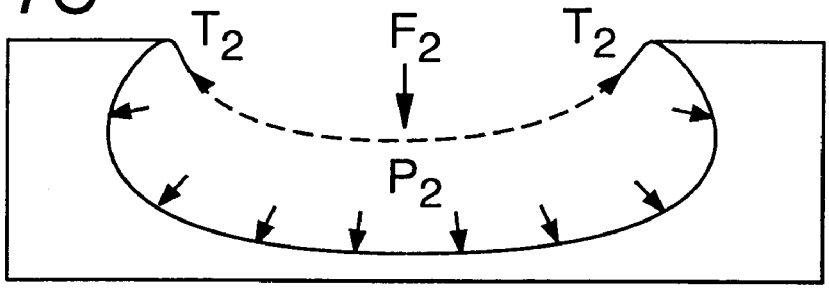
FIG. 17C is a diagrammatic cross-section of a sealed chamber illustrating film tensioning and internal pressure when increasing force is applied to the sealed chamber.

FIG. 17C diagrammatically illustrates increasing calcaneal force $F_2$ being applied to bladder 16, for example during walking. As seen therein, the volume of bladder 16 has been reduced further, thereby increasing the pressure within the bladder to $P_2$ and the tension along primary surface 18 to $T_2$.

Figure 17D:
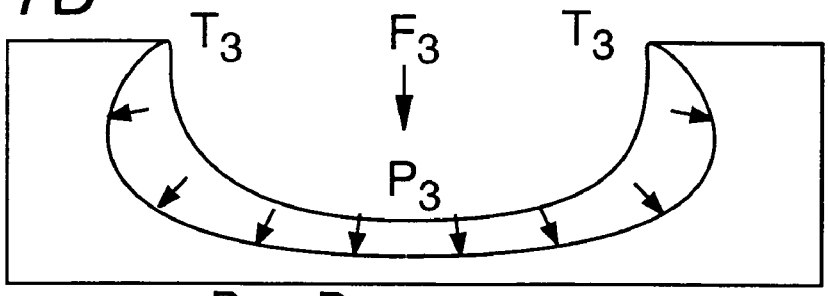
FIG. 17D is a diagrammatic cross-section of a sealed chamber illustrating film tensioning and internal pressure when high force is applied to the sealed chamber.

FIG. 17D illustrates maximum calcaneal force $F_3$ being applied to bladder 16, for example during running. As seen therein, the volume of bladder 16 has been reduced substantially, thereby substantially increasing the pressure within the bladder to $P_3$ and the tension along primary surface 18 to $T_3$. Since the interior area of the bladder is devoid of internal connection filled with foam, the bladder can compress a significant degree, as seen in FIG. 17D, thereby enhancing the ability of the bladder to absorb shock. While undergoing this deflection, the pressure is ramping up, such as from $P_0$ (ambient) to $P_3$ (greater than 30 psi). The increase in pressure in the bladder, together with the increasing stiffness of the foam material along the sides of the bladder, help stabilize the footbed. The desired objective of maximum deflection for shock absorption, in combination with medial to lateral stability is thus attained with the combination of the appropriately shaped bladder at ambient pressure within an elastomeric material.

Both air bladders 14 and 16, and sealed chamber 14' contain ambient air and are configured to be sealed at ambient pressure or slightly elevated pressure, within 5 psi (gauge) of ambient pressure. The low or no pressurization provides sufficient cushioning for even repeated, cyclic loads. Because high pressurization is not required, air bladders 14 and 16 are not material dependent, and correspondingly, there is no requirement for the use of specialized gases such as nitrogen or sulfur hexafluoride, or specialized barrier materials to form the bladders. Avoiding these specialized materials results in significant cost savings as well as economies of manufacture.

By varying the orientation and placement of the pear-shaped or taper shaped air bladders sealed at ambient pressure or within 5 psi of ambient pressure, it has been found that a variety of customized cushioning responses are attainable.

The preferred methods of manufacturing the bladders are blow-molding and vacuum forming. Blow-molding is a well-known technique, which is well suited to economically produce large quantities of consistent articles. The tube of elastomeric material is placed in a mold and air is provided through the column to push the material against the mold. Blow-molding produces clean, cosmetically appealing articles with small inconspicuous seams. Many other prior art bladder manufacturing methods require multiple manufacturing steps, components and materials which makes them difficult and costly to produce. Some prior art methods form conspicuously large seams around their perimeters, which can be cosmetically unappealing. Vacuum forming is analogous to blow-molding in that material, preferably in sheet form, is placed into the mold to take the shape of the mold, however, in addition to introducing air into the mold, air is evacuated out to pull the barrier material to the sides of the mold. Vacuum forming can be done with flat sheets of barrier material which can be more cost effective than obtaining bars, tubes or columns of material typically used in blow molding elastomeric. A conventional thermoplastic urethane can be used to form the bladder. Other suitable materials are thermoplastic elastomers, polyester polyurethane, polyether polyurethane, and the like. Other suitable materials are identified in the '156 and '945 patents.

Figure 15:
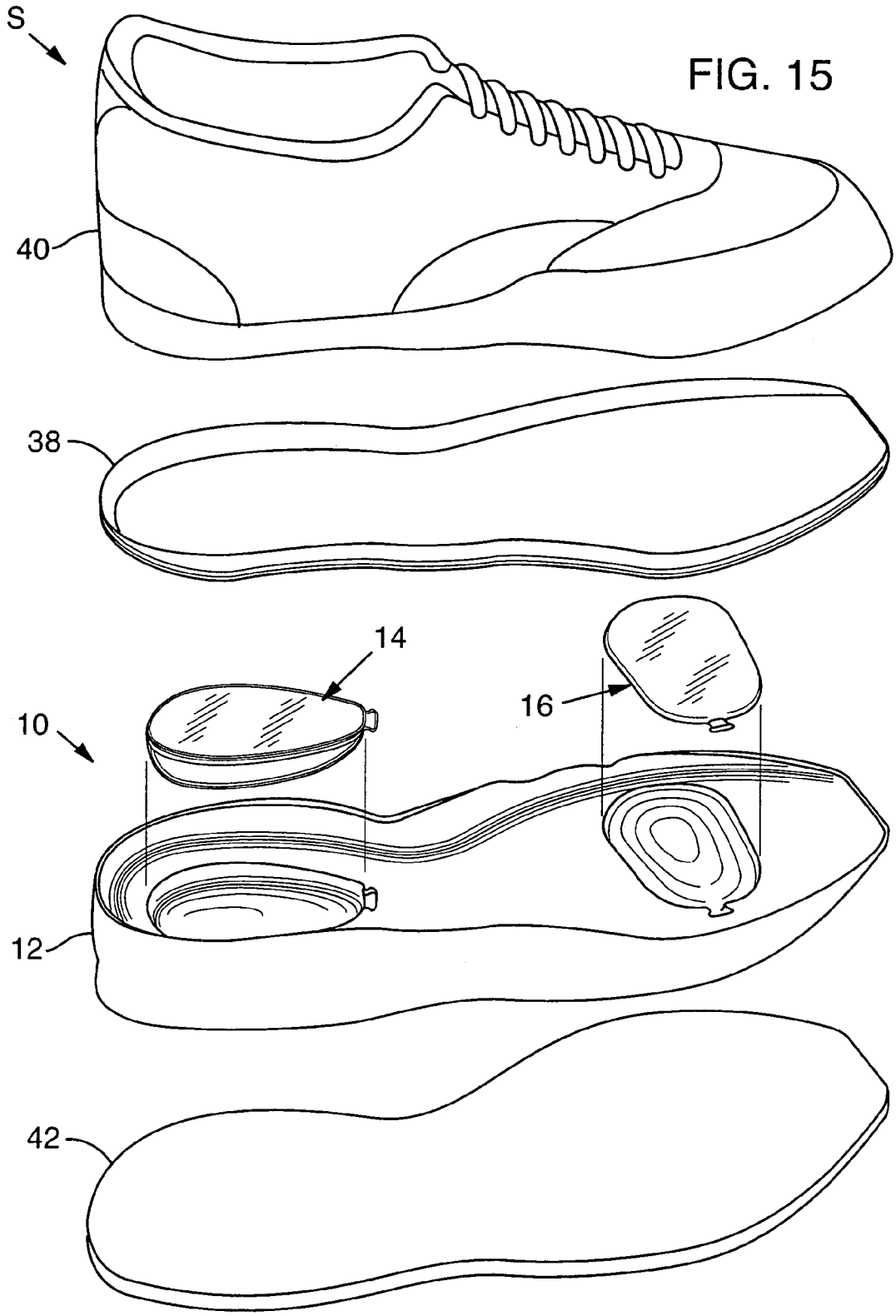
FIG. 15 is an exploded assembly view of the cushioning system shown in FIG. 1 with other elements of a shoe assembly.

The cushioning components of the present invention are shown as they would be assembled in a shoe S in FIG. 15. Cushioning system 10 is generally placed between a liner 38, which is attached to a shoe upper 40, and an outsole 42, which is the ground engaging portion of the shoe.

From the foregoing detailed description, it will be evident that there are a number of changes, adaptations, and modifications of the present invention that come within the province of those skilled in the art. However, it is intended that all such variations not departing from the spirit of the invention be considered as within the scope thereof as limited solely by the claims appended hereto.

The invention claimed is:

1. A sole component for footwear comprising:

a scaled chamber containing a fluid, said chamber having a first major surface with a first perimeter border, an opposing second major surface with a second perimeter border, and a sidewall surface connecting the first and second perimeter borders of said major surfaces, said first and second major surfaces being devoid of internal connection, said second perimeter border located inward of said first perimeter border such that said sidewall surface contours outwardly from said second major surface to said first major surface, said first and second borders each having first and second narrow sides and first and second long sides, said first narrow side being longer than said second narrow side so that said first and second long sides angle toward one another extending from said first narrow side to said second narrow side, and said first and second narrow sides being curved so that said chamber has a pear shape, a substantial portion of said first major surface being substantially planar, and a substantial portion of said second major surface being substantially planar and with less than 50% of the area of said substantially planar portion of said first major surface; and a resilient material surrounding at least a portion of said chamber, said chamber being formed, at least in part, by a void formed in said resilient material, and at least one of said major surfaces and at least, one of the perimeter borders being formed by walls of the void in said resilient material, said resilient material covering a substantial portion of at least one of said major surfaces.

2. The sole component of claim 1, wherein said first major surface is connected to said second major surface solely by said sidewall surface.

3. The sole component of claim 1, wherein said first narrow side of said second border is located closer to said first narrow side of said first border than the second narrow side of said second border is located relative to said second narrow side of said first border.

4. The sole component of claim 1, wherein both of the perimeter borders are formed by walls of the void in said resilient material and the other of said major surfaces is formed of a separate component attached to said resilient material.

5. The sole component of claim 1, wherein both of the major surfaces and both of the perimeter borders are defined by walls of the void in the resilient material.

6. The sole component of claim 1, wherein the sole component is incorporated into said footwear.

7. A sole component for footwear comprising:

a sealed chamber containing air at a pressure between ambient pressure and 5 psi of ambient pressure, said chamber having a substantially planar first major surface with a first perimeter border in a pear shape with a rounded end and a narrow end, an opposing substantially planar second major surface with a second perimeter border in a pear shape with a rounded end and a narrow end, and a sidewall surface connecting the first and second perimeter borders of said major surfaces, said second major surface having a surface area less than 50% of a surface area of said first major surface so that said second perimeter border is located inward of said first perimeter border, said first and second major surfaces being orientated with respect to one another so that the respective rounded ends of said pear shapes are closer together than respective narrower ends of said pear shapes, and said sidewall surface contours outwardly from said second major surface to said first major surface; and a resilient material surrounding a substantial portion of at least one of said major surfaces of said chamber, said chamber being formed, at least in part, by a void formed in said resilient material, and at least one of said major surfaces and at least one of the perimeter borders being formed by walls of the void in said resilient material.

8. The sole component of claim 7, wherein all of the perimeter borders are formed by walls of the void in said resilient material and the other of said major surfaces is formed of a separate component attached to said resilient material.

9. The sole component of claim 7, wherein both of the major surfaces and all of the perimeter borders are defined by walls of the void in the resilient material.

10. The sole component of claim 7, wherein the sole component is incorporated into said footwear.

11. A sole component for footwear comprising:

a polymer foam element wit a surface that defines a concave area extending into the polymer foam element from the surface; and a separate element joined to the polymer foam element, the separate element extending across an opening of the concave area to form a sealed chamber between a surface of the separate element and a surface of the concave area, the sealed chamber enclosing a fluid tat extends from the surface of the separate element to the surface of the concave area, the chamber having a first major surface, a second major surface, and a sidewall surface, the first major surface having a taper-shaped outline with a first end portion and a second end portion, the second major surface also having a taper-shaped outline with a first end portion and a second end portion, the taper-shaped outline of the second major surface being smaller in area than the taper-shaped outline of the first major surface and generally parallel thereto, and the sidewall surface connects the first major surface and the second major surface, to first major surface being formed by the surface of the separate element, and each of the sidewall surface and the second major surface being formed by the surface of the concave area.

12. The sole component of claim 11, wherein the fluid is air at a pressure between ambient pressure and 5 psi of ambient pressure.

13. The sole component of claim 11, wherein the first major surface and the second major surface are substantially planar.

14. The sole component of claim 11, wherein to first major surface and the second major surface are substantially parallel.

15. The sole component of claim 11, wherein the second major surface has a surface area less than 50% of a surface area of the first major surface.

16. The sole component recited in claim 11, wherein the chamber is devoid of internal connections between the first major surface and the second major surface.

17. The sole component of claim 11, wherein the separate element is a layer of polymer material.

18. A sole component for footwear comprising:

a polymer foam element with a surface that defines a concave area extending into the polymer foam element from the surface; and a separate element joined to the polymer foam element, the separate element extending across an opening of the concave area to form a sealed chamber between a surface of the separate element and a surface of the concave area, the sealed chamber enclosing a fluid that extends from the surface of the separate element to the surface of the concave area, the chamber having a first major surface, a second major surface, and a sidewall surface, the first major surface having a first perimeter border in a pear shape with a rounded end and a narrow end, the second major surface having a second perimeter border in a pear shape with a rounded end and a narrow end, and the sidewall surface connecting the first and second perimeter borders of the major surfaces, the second major surface having a surface area less than 50% of a surface area of the first major surface, and the sidewall surface contours outwardly from the second major surface to the first major surface, the first major surface being fanned by the surface of the separate element, and each of the sidewall surface and the second major surface being farmed by the surface of the concave area.

19. The sole component of claim 18, wherein the fluid is air at a pressure between ambient pressure and 5 psi of ambient pressure.

20. The sole component of claim 18, wherein the first major surface and the second major surface are substantially planar.

21. The sole component of claim 18, wherein the first major surface and the second major surface are substantially parallel.

22. The sole component recited in claim 18, wherein the chamber is devoid of internal connections between the first major surface and the second major surface.

23. The sole component of claim 18, wherein the separate element is a layer of polymer material.

24. A sole component for footwear comprising:

a polymer foam element with an upper surface that defines a concave area extending downward and into the polymer foam element from the upper surface, the upper surface defining an area for joining to an upper of the footwear; and a separate element joined to the polymer foam element, the separate element extending over the concave area to form a sealed chamber between a surface of the separate element and a surface of the concave area, the sealed chamber enclosing a fluid that extends from the surface of the separate element to the surface of the concave area, the chamber having a lint major surface ths is substantially planar, a second major surface that is substantially planar and parallel to the first major surface, and a sidewall surface, the first major surface having a first perimeter border in a pear shape with a rounded end and a narrow end, the second major surface having a second perimeter border in a pear shape with a rounded end and a narrow end, and the sidewall surface connecting the first and second perimeter borders of the major surfaces, the second major surface having a surface area less than 50% of a surface area of the first major surface, and the sidewall surface contours outwardly from the second major surface to the first major surface, the first major surface being formed by the surface of the separate element and each of the sidewall surface and the second major surface being formed by the surface of the concave area, the chamber being devoid of internal connections between the first major surface and the second major surface.

25. The sole component of claim 24, wherein the fluid is air at a pressure between ambient pressure and 5 psi of ambient pressure.

26. The sole component of claim 24, wherein the separate element is a layer of polymer material.

* * * * *